United States Patent [19]

Noell et al.

[11] 4,289,460

[45] Sep. 15, 1981

[54] BEARING LUBRICATION SYSTEM FOR GEAR PUMP HAVING CLEARANCE BETWEEN BEARING AND HOUSING WALL FOR PREVENTING ENTRY OF CONTAMINANTS LARGER THAN LUBRICATION PASSAGE

[75] Inventors: Godwin L. Noell, Winsted; Paul L. Haynes, Jr., Pleasant Valley, both of Conn.

[73] Assignee: Chandler Evans Inc., West Hartford, Conn.

[21] Appl. No.: 52,789

[22] Filed: Jun. 28, 1979

[51] Int. Cl.[3] ..... F04C 2/18; F04C 15/00

[52] U.S. Cl. ..... 418/78; 418/102; 418/131

[58] Field of Search ..... 418/75, 78, 102, 131, 418/132

[56] References Cited

U.S. PATENT DOCUMENTS

| | | | |
|---|---|---|---|
| 2,993,450 | 7/1961 | Weigert | 418/102 |
| 3,043,230 | 7/1962 | Molly | 418/131 |
| 3,313,238 | 4/1967 | Muller et al. | 418/131 |

FOREIGN PATENT DOCUMENTS

| | | | |
|---|---|---|---|
| 1272128 | 7/1968 | Fed. Rep. of Germany | 418/131 |
| 2239903 | 2/1975 | France | 418/102 |
| 1386237 | 3/1975 | United Kingdom | 418/102 |

*Primary Examiner*—John J. Vrablik

*Attorney, Agent, or Firm*—Radford W. Luther; Richard A. Dornon

[57] ABSTRACT

A gear pump suitable for pumping contaminated fuel has a lubrication passage in a pump bearing which receives fuel from the clearance volume between the bearing and the housing in the pump discharge arc. The clearance entrance between the bearing and the housing, which functions as a filter, is smaller than the passage so that contaminants traversing the clearance will not obstruct the passage. Since only contaminants smaller than the clearance entrance can enter the passage, the passage may be made sufficiently small so as not to adversely affect pump performance.

4 Claims, 10 Drawing Figures

HOUSING/BEARING CLEARANCE

BEARING LUBRICATION SYSTEM FOR GEAR PUMP HAVING CLEARANCE BETWEEN BEARING AND HOUSING WALL FOR PREVENTING ENTRY OF CONTAMINANTS LARGER THAN LUBRICATION PASSAGE

BACKGROUND OF THE INVENTION

This invention relates to gear pumps and more particularly to gear pumps adapted to pump contaminated fluid.

Many fuel supply systems for gas turbine engines employ high pressure gear pumps to furnished engine fuel. In addition, such pumps may provide hydraulic supply pressure for actuator systems.

A typical gear pump embodies a pair of steel gears connected to shaft journals which turn in bronze bearings. The bearings include passages which extend from the bearing faces to the bearing interiors for lubricating and cooling the bearing surfaces of the shaft journals. Obviously, the passages must be of a sufficient size to insure that no clogging will be occasioned by contaminants in the fluid being pumped. The main problem encountered in using large lubrication passages is the diminution of the pumps volumetric efficiency.

An alternative approach is to provide a source of filtered fluid for lubrication purposes. This arrangement necessarily entails the use of either a barrier or wash flow type filter and appropriate housing coring to direct filtered fluid to the bearings.

SUMMARY OF THE INVENTION

The invention provides a gear pump adapted to pump contaminated fluid in which discharge leakage flow traversing the radial clearances formed between the bearing and the adjacent housing wall portion is directed to the shaft journals via lubrication passages in the bearing. The dimensions of the clearance entrance are such that no contaminant larger than the lubrication passage is permitted entry, whereby the lubrication passage is not likely to become clogged. A groove on the outer periphery of the bearing communicates with the clearance volume and the lubrication passage. The groove is of a size (length, width, and depth) selected to produce the desired flow in the lubrication passage. In addition, the clearance is sized so that leakage flow along the outer periphery of the bearing will be less than the gear sweep velocity whereby there will be no tendency to draw contaminants into the clearance volume.

The invention provides an uncomplicated lubrication system for a gear pump adapted to pump contaminated fluid which does not mandate the use of large lubrication passages or filters.

Accordingly, it is a primary object of the invention to provide a bearing lubrication system for a gear pump adapted to pump contaminated fluid.

Another object is to provide a bearing lubrication system for a gear pump adapted to pump contaminated fluid wherein the size of lubrication passage is minimized.

A further object is to provide a bearing lubrication system wherein the entrance to the clearance volume between the bearing and the pump housing functions to filter out contaminants in the fluid utilized for lubrication.

These and other objects and advantages of the invention will become more readily apparent from the following detailed description, when taken in conjunction with the accompanying drawings, in which:

DETAILED DESCRIPTION OF PREFERRED EMBODIMENT

Figure 1:
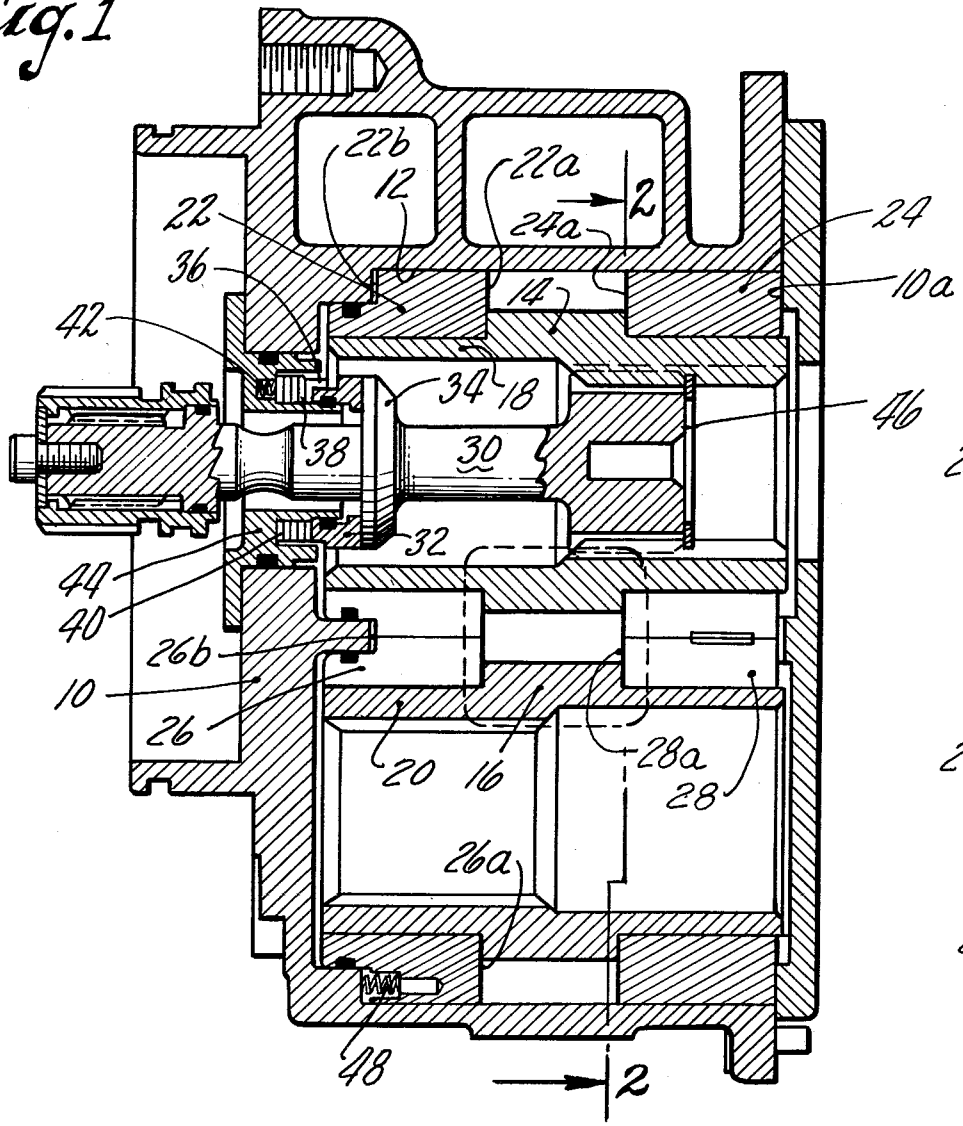
FIG. 1 is a longitudinal cross sectional view of a gear pump according to the invention.
Figure 4:
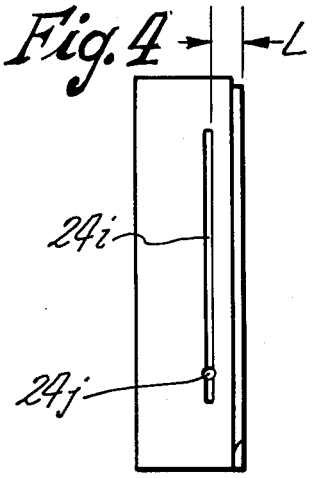
FIG. 4 is a front elevational view of the bearing of FIG. 3, taken along the line 4—4 of FIG. 3.
Figure 3:
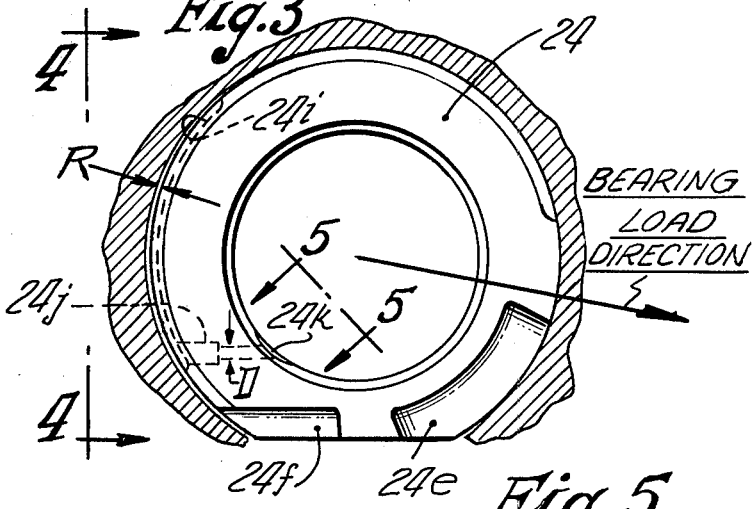
FIG. 3 is a side elevational view of a bearing of FIG. 1.
Figure 6:
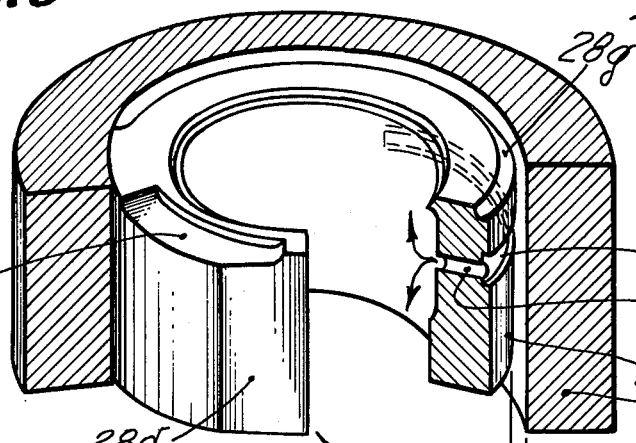
FIG. 6 is a fragmentary, perspective view, partially broken away, showing the relationship between the bearing periphery and the pump housing.
Figure 5:
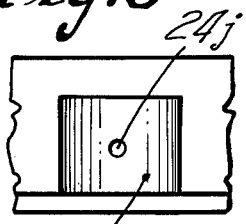
FIG. 5 is a view of the lubrication pocket taken along the line 5—5 of FIG. 3.

Referring to FIG. 1, there is shown a gear pump of the invention comprising a pump housing 10 having an ovoid pumping cavity 12. Within the pumping cavity 12 are mounted the usual pair of meshing gears 14 and 16. The gears 14 and 16, each of which are carried by shaft journals 18 and 20, are mounted for rotation within the interior portions of bearings 22, 24 and 26, 28. The gear 14, which is the driver gear, is rotated by a drive shaft 30 in splined engagement with the shaft journal 18. A face seal 32 is urged against a flange 34 on the drive shaft by a seal assembly consisting of a key washer 36, dimpled washer 38, a flat washer 40, a plurality of springs 42 and a seal retainer 44 suitably secured to the housing 10 by suitable means (not shown). The right end of the drive shaft abuts and is maintained in place by a retaining ring 46.

The bearings 22 and 26 have their faces 22*a* and 26*a* in wiping engagement with the left side faces of the gears 14 and 16 in the usual manner. Similarly, the faces 24*a* and 28*a* of the bearings 24 and 28 are in wiping engagement with the right side faces of the gears 14 and 16. A plurality of springs 48 in the bearings 22 and 26 apply an axial force to their associated bearings in the direction of the gears. This force is supplemented by the pump discharge pressure acting upon annuli 22*b* and 26*b*. The right side faces of the gears, in turn, urge the bearings 24 and 28 toward the right into firm engagement with the wall 10*a* of the cavity 12. The result of this commonly employed axial sealing is to prevent leakage in the discharge area of the pump which would otherwise be occasioned by discharge pressure causing separation between the bearings and the side faces of the gears.

Figure 2:
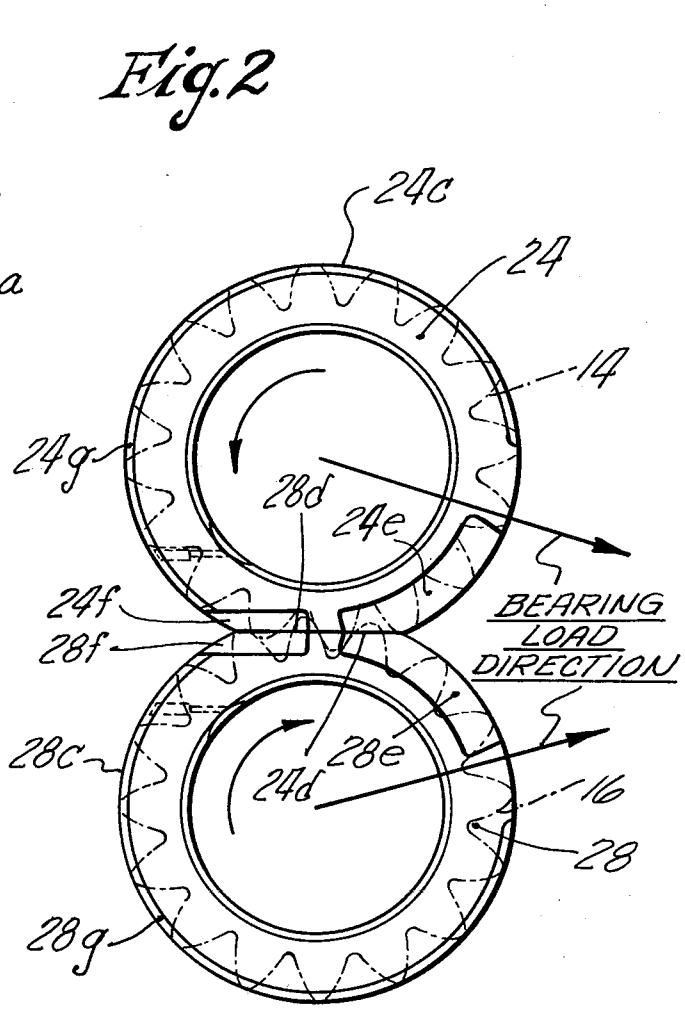
FIG. 2 is a side elevational view of two of the pump bearings of FIG. 1, taken along the line 2—2 of FIG. 1.

The basic construction and arrangement of the bearings may best be appreciated by reference to FIGS. 1 and 2, in concert. Bearing 24 has a generally cylindrical outer periphery 24*c* and a flat 24*d* which seats against the flat 28*d* of the adjacent bearing 28. Relieved from the respective faces of bearings 24 and 28 are the usual confronting inlet ramps 24*e* and 28*e* and discharge ramps 24*f* and 28*f* which prevent trapped fluid in between the gear teeth from effecting a separation of the bearings. The bearings 24 and 28 also include pressure distribution annuli 24*g* and 28*g* to bring about a direction of bearing loading which urges the bearings into engagement. It will be appreciated that in general bearing 24 is the mirror image of bearing 28 and that the same is true of the bearings 22 and 26.

With reference to FIGS. 3, 4, 5, and 6, various views of the bearing 26, which is typical, depict the constructional features of the bearing which serve to provide lubrication and their relationship to the pump housing. It will be understood that the other bearings have similar lubrication features and therefore will not be specifically described.

Bearing 24 has a groove 24*i* fashioned on its outer periphery which occupies an angle of about 75° in the discharge area. As illustrated, this angle is approximately bisected by the bearing loading vector. Communicating with the groove 24*i* is a radially extending lubrication passage 24*j* which supplies a lubrication pocket 24*k* formed on the inner periphery or interior portion of the bearing. The groove 24*i* has length, width, and depth sufficient to supply the passage 24*j* with fluid which has encountered only a minimal pressure drop. The passage 24*j* has a diameter D significantly larger than the maximum radial clearance R between the housing and the bearing when the bearing is loaded in the direction shown into firm engagement with the opposing housing wall. Hence, the clearance entrance is small enough to filter out any contaminants which could possibly clog the passage 24*j*. It will also be understood that the groove, which communicates with the clearance volume, is spaced from the face of the bearing a distance L sufficient to position passage 24*j* for proper lubrication of bearing (i.e., its outlet position in pocket 24*k*).

It would be profitable to also examine some further design considerations. For example, it is important to maintain the velocity of flow in the clearance volume at a low value relative to the gear sweep velocity in order to preclude contaminants from being drawn into the clearance volume. Moreover, the design of the lubrication groove and the selection of a proper clearance dimension should entail a full consideration of all operating parameters, such as temperature and fluid viscosity. In this regard, it will be appreciated that a temperature increase could have a tendency to restrict clearances, thereby adversely affecting bearing lubrication.

FIGS. 7, 8, 9 and 10 show various alternative bearing embodiments suitable for incorporation in a pump of the invention.

Figure 7:
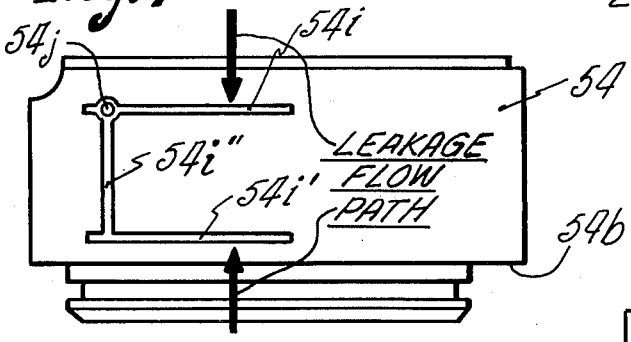
FIG. 7 is a view of an alternative form of bearing.

In FIG. 7, it will be seen that bearing 54 is provided with spaced parallel grooves 54*i* and 54*i*' to receive leakage flow not only from the clearance entrance adjacent the gears but also from the clearance entrance adjacent annuli 54*b* which is exposed to discharge pressure. It will be noted that the construction of bearing 54 is identical to that of bearing 22 save for depicted groove and lubrication passage arrangement. Grooves 54*i*' and lubrication passage 54*j* are interconnected by a groove 54*i*''. The embodiment shown in FIG. 7 is advantageous in that it provides a means for collecting clean fuel which encounters minimum pressure drops and attains minimal velocities. Low velocities are of course conducive to the exclusion of contaminants from the clearance volume.

Figure 8:
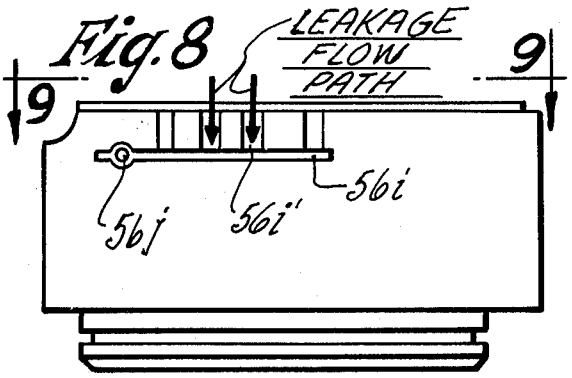
FIG. 8 is a view of another alternative form of bearing.
Figure 9:
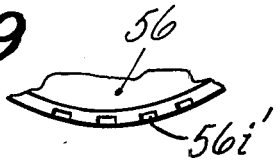
FIG. 9 is a fragmentary view of the bearing of FIG. 8, taken along the line 9—9 thereof.

In the embodiment of FIGS. 8 and 9, the periphery of bearing 56 embodies a plurality of axially directed small slab cuts 56*i*' which will extend from the edge of the bearing to the groove 56*i*. Such slab cuts will serve to prevent the loss of lubricating flow to the lubrication passage 56*j* in the event of a thermal expansion which would tend to restrict clearance between the bearing and the bearing housing.

Figure 10:
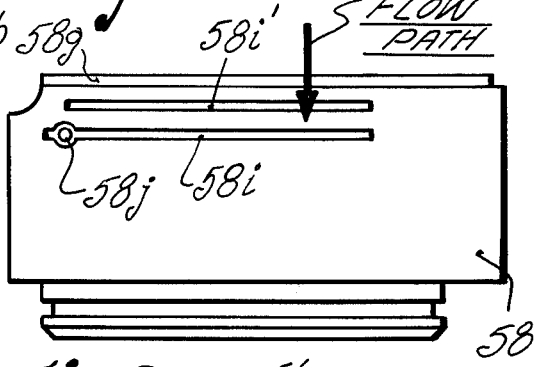
FIG. 10 is a view of a further alternative form of bearing.

Turning now to the embodiment of FIG. 10, a bearing 58 not only incorporates a groove 58*i* and a lubricating passage 58*j* similar to those previously described but also embodies yet another groove 58*i*' disposed between the groove 58*i* and the pressure distribution annulus 58*g*. The function of the groove 58*i*' is to collect contaminants and thereby enhance the filtration capability of the clearance.

Obviously, many modifications and variations are possible in light of the above teachings without departing from the scope and spirit of the invention as defined in the appended claims. For example, the number of bearings employed and the nature of their interrelationship, be they separate elements as depicted or one piece elements, are matters of design choice. Moreover, the number of shaft journals employed admits of many variations. In addition, the groove geometry may be different from that specifically described. For instance, the groove could be made circular, oval, or sinuous without departing from the principles of the invention and its axis need not lie in a plane perpendicular to the bearing axis. It will be further understood that more than one lubrication passage could be utilized and that a lubrication passage could bifurcate.

We claim:

1. In a gear pump of the type having a housing with a pumping cavity therein, an inlet in fluid connection with the cavity and an outlet in fluid connection with the cavity, at least two gears disposed in the cavity such that the teeth thereof are in meshing engagement, a shaft journal connected to one of the gears and a bearing in the cavity for mounting the shaft journal for rotation in an interior portion thereof, the bearing having an outer peripheral portion closely conforming to the adjacent cavity wall and the bearing having a face in confronting relationship to a side face of the said one of the gears, the resultant loading upon the bearing when substantial discharge pressure is developed being such as to urge the bearing into firm engagement with the inlet side of the pumping cavity wall whereby a clearance volume exposed to discharge pressure is defined between the discharge side of the pumping cavity wall and the outer periphery of the bearing, the improvement comprising:

a lubrication passage in the bearing fluidly interconnecting the clearance volume with the interior portion of the bearing for directing lubricating fluid to the shaft journal;

a groove on the outer periphery of the bearing in communication with the clearance volume and the lubrication passage for supplying fluid thereto;

the entrance to the clearance volume adjacent the said one of the gears being of a predetermined radial dimension adequate to provide satisfactory lubrication but sufficiently small to prevent entry of centain contaminants and the lubrication passage being sized larger than the clearance entrance radial dimension so as not to be obstructed by contaminants traversing the entrance and entering the clearance volume.

2. The improvement, as defined in claim 1, further comprising:

an additional groove on the outer periphery of the bearing in communication with the clearance volume, the additional groove being in spaced parallel relationship to the first mentioned groove, the first mentioned groove being adapted to receive flow from the clearance entrance adjacent the said one of the gears and the additional groove being adapted to receive flow from the entrance to the clearance volume remote from the said one of the gears, the clearance entrances being of the same size, and a further groove on the outer periphery of the bearing to fluidly interconnect the additional groove and the lubrication passage.

3. The improvement, as defined in claim 1, further comprising:

a plurality of slab cuts on the outer periphery of the bearing extending from the clearance entrance to the groove to ensure sufficient flow to the groove in the event that the size of the clearance entrance is restricted by thermal expansion of the bearing.

4. The improvement, as defined in claim 1, further comprising:

a second groove on the outer periphery of the bearing in communication with the clearance volume in parallel spaced relationship to the first mentioned groove, the second groove being disposed intermediate the first mentioned groove and the clearance entrance for contaminant collection.

* * * * *